United States Patent [19]

Gallegos

[11] 4,176,580

[45] Dec. 4, 1979

[54] SUPPORTING BRACKET FOR MUSICAL INSTRUMENTS

[76] Inventor: Manuel Gallegos, 3734 Franklin, Denver, Colo. 80205

[21] Appl. No.: 883,525

[22] Filed: Mar. 6, 1978

[51] Int. Cl.[2] ..... G10G 5/00

[52] U.S. Cl. ..... 84/327; 148/224.1

[58] Field of Search ..... 84/327; 248/224.1

[56] References Cited

U.S. PATENT DOCUMENTS

| | | | |
|---|---|---|---|
| 1,787,734 | 6/1931 | Rowling | 248/224.1 |
| 3,958,786 | 5/1976 | Mann | 84/327 X |
| 4,078,753 | 3/1978 | Cole | 84/327 X |

FOREIGN PATENT DOCUMENTS

| | | | |
|---|---|---|---|
| 54439 | 6/1921 | Sweden | 248/224.1 |

*Primary Examiner*—Lawrence R. Franklin

*Attorney, Agent, or Firm*—W. Britton Moore

[57] ABSTRACT

A supporting bracket for guitars and other stringed instruments embodying a plate attachable to a wall surface and having a hanger member with spaced diverging arms extending at right angles thereto and projecting from the wall surface to receive a finger board portion therebetween to permit of an instrument being retained thereby and depending angularly therefrom so as to be spaced above the floor surface.

4 Claims, 5 Drawing Figures

SUPPORTING BRACKET FOR MUSICAL INSTRUMENTS

This invention relates to a supporting bracket for guitars and other stringed musical instruments for enabling instruments to be supported and retained in tilted or hanging depending relationship with respect to a wall and above a floor surface.

It is usually the practice for musicians, particularly those performing in musical groups, to conveniently support their stringed instruments and the like for ready accessibility in the congested space usually available by tilting them against a wall surface which makes them subject to being dislodged therefrom and tumbling to the floor with attendant damage. While various supporting stands and brackets, such as those represented by U.S. Pat Nos. to Venter 1,176,184, Oettinger 1,612,148, Szigeti 1,758,985, and Citro 2,547,924, have heretofore been proposed, none thereof have enabled stringed instruments to be securely supported above a floor surface and against wall surfaces.

The principal object of the present invention is to provide a supporting bracket for guitars and the like including a flat plate attachable to a wall surface and having a flat hanger member with spaced diverging arms extending at right angles thereto and projecting from the wall surface to receive a finger board portion therebetween to permit of an instrument being supported and dependingly retained between the arms thereof in tilting or hanging relationship.

Another object is the provision of a supporting bracket embodying a flat generally V-shaped plate with the side edges curved inwardly to removably downwardly and slidably receive a depending flat leg portion of a flat hanger member having spaced diverging arms extending outwardly and at right angles relative to the leg portion.

Still another object is the provision of a supporting bracket wherein the V-shaped plate thereof is apertured for attachment to a wall and/or vertical or horizontal amplifier surface and the flat leg portion of the hanger converges for snugly interfitting the plate and is longitudinally slotted to receive the heads of the attaching screws or nails so as to permit removal of the hanger.

A further object is to provide a supporting bracket wherein the leg portion of the hanger is reversibly insertable within the V-shaped wall plate so that the hanger may either project laterally or outwardly from the leg portion and hanger or may extend rearwardly or inwardly across the top of an amplifier when not in use to avoid creating an obstacle or snagging clothing.

Still a further object is to provide a supporting bracket wherein the diverging and spaced flat hanger arms are covered or encased in plastic so that the instrument will not be marred when positioned therebetween.

A further object is the provision of either an integral one-piece or a separable two-piece supporting bracket adaptable for selective mounting on either vertical or horizontal wall surfaces.

Still another object is to provide a two-piece supporting bracket for selective mounting on either vertical or horizontal wall surfaces, and wherein there is means to interlock the wall plate and hanger leg portions to prevent dislodgement thereof.

These and other objects and advantages will be apparent as the specification is considered with the accompanying drawings, wherein FIG. 1 is a perspective view of a two-piece supporting bracket mounted on a side wall of an amplifier and showing the finger board of a guitar being supported thereby;

Figure 1:
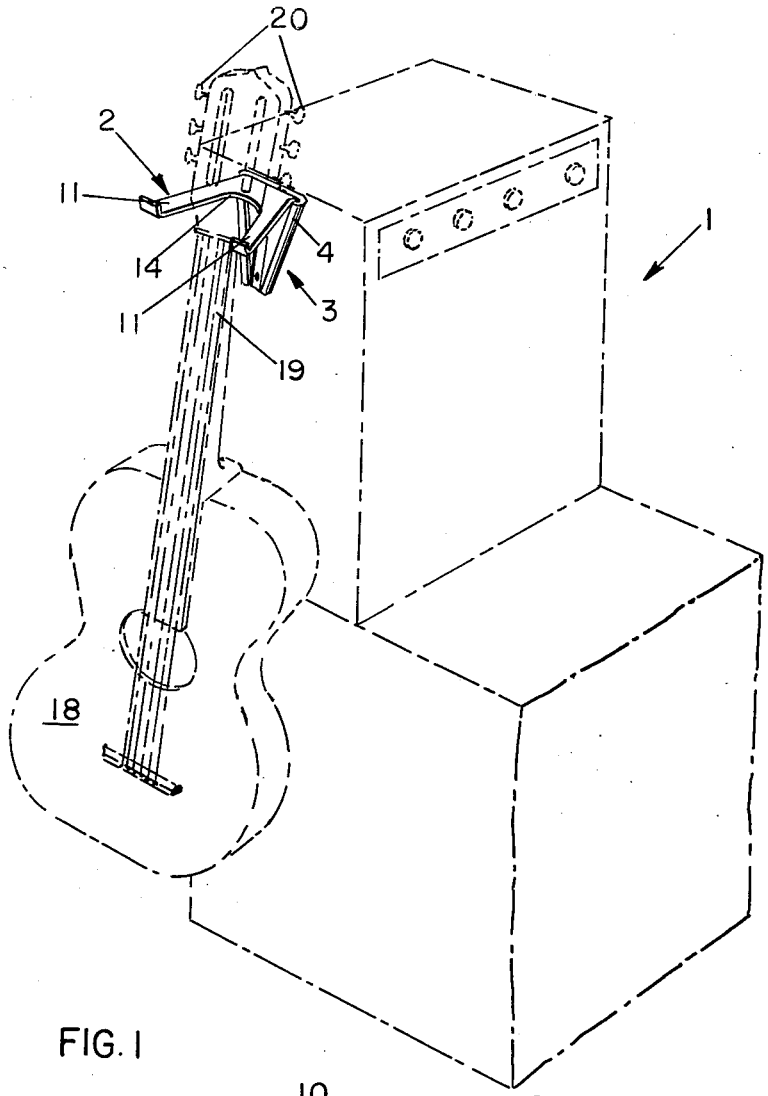

Referring more particularly to the drawings, wherein similar reference characters designate like parts throughout the several views, numeral 1 refers to a conventional generally rectangular, box-like amplifier, of the type usually employed by musicians for amplifying stringed instruments and the like, including flat front, rear, side, top and bottom walls. While the hereinafter to be described supporting bracket 2 is shown as being attached to either the side and top walls of an amplifier, it will be apparent that it may be mounted on any flat wall surface.

Figure 2:
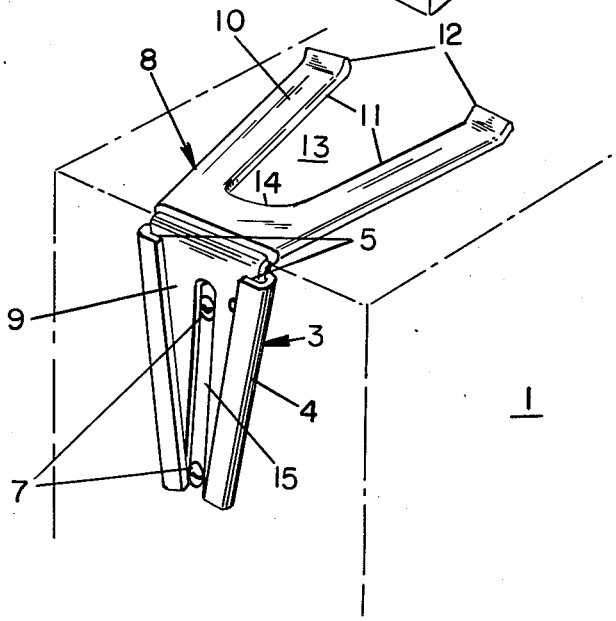
FIG. 2 is a perspective view of a two-piece supporting bracket, wherein the depending leg portion of the hanger member is reversed and the right-angularly extending arms thereof project rearwardly and overlie an upper wall of the amplifier.
Figure 3:
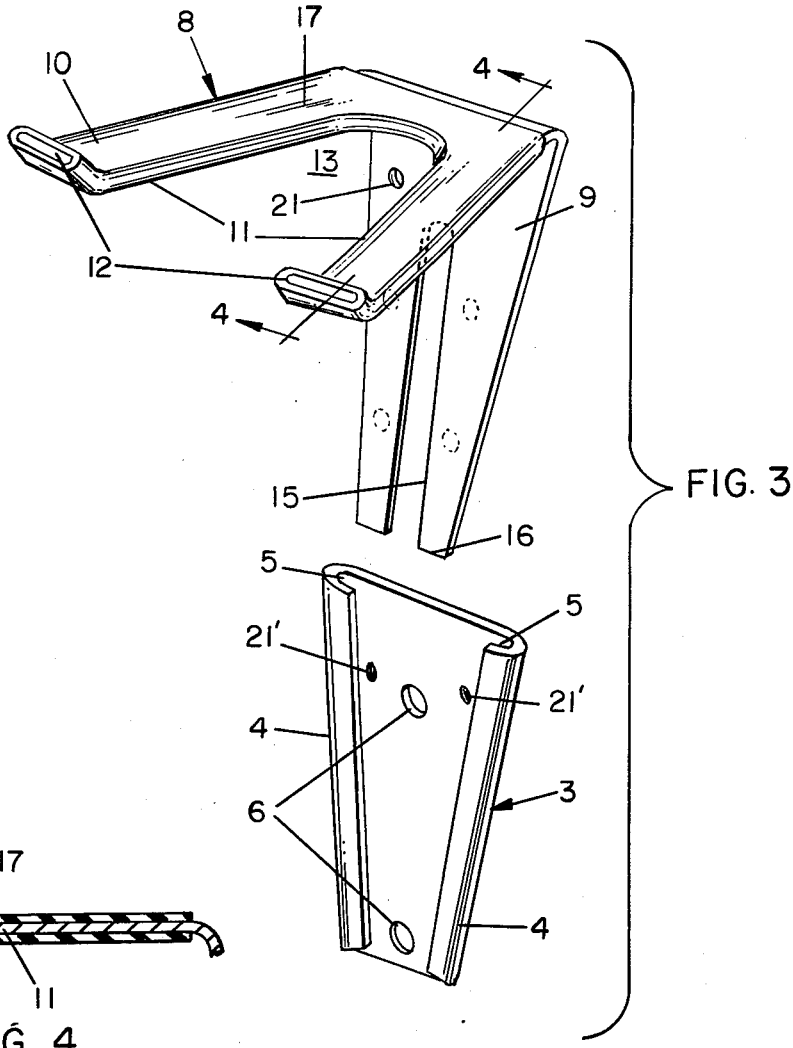
FIG. 3 is an exploded view of the two-piece supporting bracket prior to being interconnected.
Figure 4:
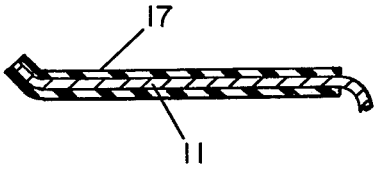
FIG. 4 is a section on the line 4—4 of FIG. 3.

As best illustrated in FIG. 3, the supporting bracket 2 is of two-piece construction and includes a flat generally V-shaped mounting plate 3 having its side edges bent outwardly and inwardly, as at 4, to provide elongated channels 5 extending lengthwise from end to end thereof. Spaced apertures 6 are formed in plate 3 to receive screws or the like 7 for attaching the plate to either an amplifier side wall, as shown in FIGS. 1 and 2, or a top wall thereof, as in FIG. 5, or to any other wall surface, not shown. Plate 3 may be formed of any suitable material, such as metal or plastic, so as to provide a firm support for the hanger support member, about to be described.

A hanger supporting plate 8, of the same material as plate 3, is of inverted L-shape with a vertical flat converging base plate 9 bent laterally at its upper end into a right-angularly and horizontally extending hanger member 10. The latter is correspondingly flat and formed with two spaced diverging arms 11 having angularly upturned outer ends 12, with an enlarged generally U-shaped open area 13 therebetween and wherein the reduced inner end is concave, as at 14. With the mounting plate 3 attached by screws 7 to a wall surface, hanger base plate 9 is sleeved therewithin so that the converging side edges of plate 9 interfit channels 5 thereof. As the heads of the screws 7 usually project above the plane of plate 3, an elongated slot 15, extending from the lower end 16 of base plate 9 to a point spaced below the upper end thereof, receives the screw heads therein and permits telescoping movement of the hanger plate, in an obvious manner. In addition, slot 15 enables the arms 11 to flex slightly so that they will snugly interfit the channels 5.

An open-ended sleeve 17 of some suitable plastic is sleeved over the hanger member 10 and the spaced arms 11 thereof and forms a protective coating thereon to prevent marring of a musical instrument supported thereby. Thus, when the mounting plate 3 is attached to a wall surface and the supporting plate 8 interconnected thereto, in the arrangement of FIG. 1, the diverging arms 11 will project outwardly from a side wall of amplifier 1. The upper end or finger board portion 19 of a guitar 18 is inserted between arms 11 and will engage with and rest on the concave inner end 14 of hanger 10. In this position, it will be apparent that the guitar string adjusting finger knobs 20 will overlie and project laterally of arms 11 and thereby prevent the upper end of the guitar slipping through the arms should the body portion of the instrument be bumped. In addition, the upturned outer ends 12 of the arms will preclude the knobs from slipping therefrom. Thus, the base 18 of the guitar will be spaced above the floor surface.

Figure 5:
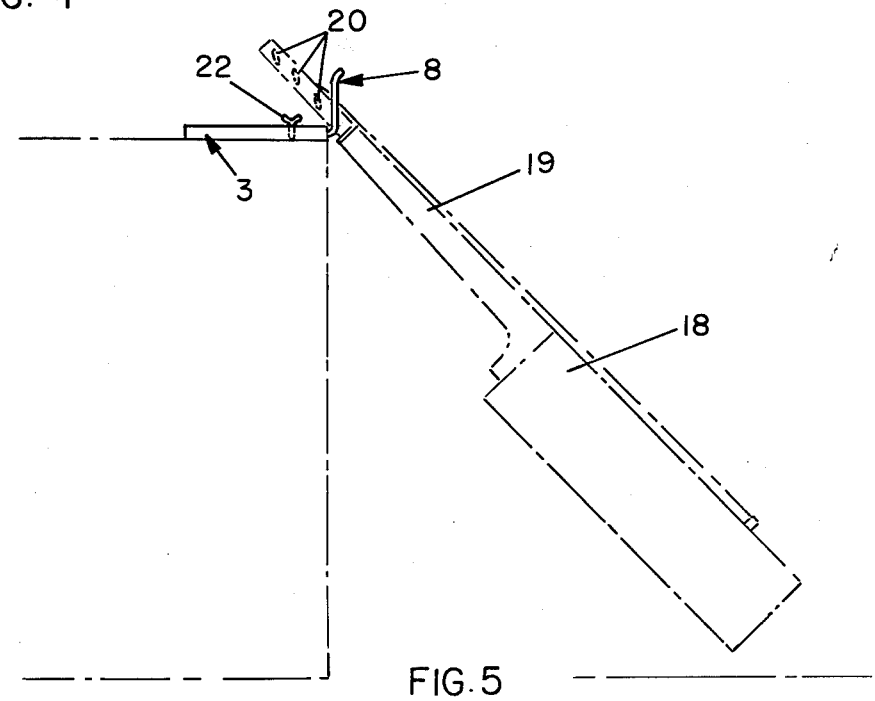
FIG. 5 is a side elevation showing the bracket mounted on the top of an amplifier with the hanger portion projecting upwardly therefrom and supporting a guitar thereat.

If desired, the supporting bracket 2 may be arranged, as shown in FIG. 5, on the flat top surface of amplifier 1 so as to be horizontally disposed thereon with the arms 11 projecting upwardly therefrom generally in a plane with the side wall. When so positioned, the arms will not present an obstacle to passage by the amplifier. Accordingly, it is desirable to provide a hole 21 (FIG. 3) in base plate 9 which is alignable with either of holes 21' on each side of mounting plate 3 and are adapted to receive a suitable threaded locking pin or screw 22 which serves to prevent base plate 9 from being dislodged from plate 3. It will, of course, be apparent that for storage purposes, the base plate 9 may be reversed so that the hanger arms 11 may project downwardly of the side wall of the amplifier.

When use of the supporting bracket is not required, such as during storage of an instrument in its carrying case, it may be desirable to so arrange the bracket that it does not present an obstacle and removes the possibility of the hanger plate snagging garments and the like. This may be readily accomplished by reversing the position of the base plate 9 in mounting plate 3 from FIG. 1 to FIG. 2 positions, wherein the hanger member 10 thereof will extend inwardly over and engage the top surface of the amplifier.

In lieu of the two-piece embodiment described above, a simplified version of supporting bracket, not shown, may be used so as to provide a fixed wall rack. This may be effected by omitting the V-shaped mounting plate 3 and providing additional screw receiving apertures in the base plate 9 of supporting plate 8 so that the latter may be directly and fixedly attached to a wall surface, in an obvious manner.

While a preferred embodiment has been shown and described, and a modification thereof has been herein described, it is to be understood that various changes and revisions may be made therein without departing from the scope and spirit of the appended claims.

What I claim:

1. A supporting bracket for mounting guitars and other stringed musical instruments having finger board portions above a floor surface and selectively at hanging or tilted angles relative to a support having vertical or horizontal wall surfaces comprising a flat generally V-shaped wall mounting plate having its opposing side edges bent outwardly and inwardly to form side channels extending end to end and selectively attachable by attaching means to said vertical and horizontal wall surfaces, a generally inverted L-shaped angular supporting bracket including a vertical converging flat base portion and a horizontally extending flat hanger plate portion formed on the upper end of said flat base portion and projecting at generally right angles relative thereto, said hanger plate portion having two spaced flat converging arms providing a generally U-shaped open area therebetween with a generally concave inner end, said base portion having an elongated slot therein extending from the lower end thereof to a point spaced below the upper end whereby said base portion is sleevable within said mounting plate channels and said attaching means will project within said slot and permit of the insertion and removal of said base plate portion so as to selectively project outwardly from or inwardly relative to one of said wall surfaces, whereby said finger board portion of said guitar extends between said spaced arms and engages with said concave inner end and is thereby fixedly retained angularly relative to one of said wall surfaces and spaced above said floor surface, and whereby said base plate portion is reversibly sleevable in said wall mounting plate so that said hanger plate portion will either project outwardly from either of said wall surfaces to angularly and outwardly support said guitar or when reversedly sleeved therein the converging arms of said hanger plate portion will extend over and engage the other wall surface and will not project therefrom for inoperative and storage purposes.

2. A supporting bracket, as defined in claim 1, wherein the outer ends of said spaced arms are angularly upturned so as to prevent said finger board portion from slipping therefrom.

3. A supporting bracket, as defined in claim 2, wherein said flat hanger plate portion and the spaced arms thereof have protective covering means thereon so that the surface of said guitar will not be marred when dependingly angularly supported thereby.

4. A supporting bracket, as defined in claim 1, wherein the outer ends of the spaced arms of said hanger plate portion are angularly upturned, and said plate portion and said arms are encased in mar proof plastic.

* * * * *